US008544128B1

(12) United States Patent
Jones et al.

(10) Patent No.: US 8,544,128 B1
(45) Date of Patent: Oct. 1, 2013

(54) MULTI-TASK HAND AID

(76) Inventors: Ronald W. Jones, Weatherford, TX (US); James L. Ford, Wichita, KS (US)

( * ) Notice: Subject to any disclaimer, the term of this patent is extended or adjusted under 35 U.S.C. 154(b) by 753 days.

(21) Appl. No.: 12/459,802

(22) Filed: Jul. 8, 2009

Related U.S. Application Data

(60) Provisional application No. 61/132,393, filed on Jul. 8, 2008.

(51) Int. Cl.
*B67B 7/00* (2006.01)
*B25F 1/00* (2006.01)

(52) U.S. Cl.
USPC ..... 7/151; 81/3.4; 81/125.1; 623/65; 623/57

(58) Field of Classification Search
USPC ..... 7/151, 160, 166, 115, 122; 81/3.29, 81/3.42, 3.4
See application file for complete search history.

(56) References Cited

U.S. PATENT DOCUMENTS

| | | | | |
|---|---|---|---|---|
| 3,570,028 | A * | 3/1971 | Hitte | 81/3.4 |
| 4,523,781 | A * | 6/1985 | Brody | 294/25 |
| 4,944,766 | A * | 7/1990 | Williams | 623/65 |
| 5,621,936 | A * | 4/1997 | Penaligon et al. | 7/151 |
| 5,652,988 | A * | 8/1997 | Appelhoff | 7/151 |
| 7,438,726 | B2 * | 10/2008 | Erb | 623/57 |
| 2007/0283789 | A1 * | 12/2007 | Zeidler | 81/125.1 |

* cited by examiner

*Primary Examiner* — Monica Carter
*Assistant Examiner* — Melanie Alexander
(74) *Attorney, Agent, or Firm* — Jeffrey Roddy

(57) ABSTRACT

A hand-held tool for individuals who have diminished use of their hands or reduced gripping strength due to infirmity or medical condition that provides a number of shaped spaces for seating and manipulation of various items that would otherwise be difficult or impossible to manipulate. Among the multiple shaped spaces is a space for a writing instrument and a space for an eating utensil enabling a user to write and eat without for example, directly gripping a pencil or a fork.

10 Claims, 5 Drawing Sheets

MULTI-TASK HAND AID

CROSS REFERENCE TO RELATED APPLICATIONS

This application claims the benefit of Provisional Patent Application No. 61/132,393 filed Jul. 8, 2008

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

Multi-use tools of varying design are known in the art and typically are designed to assist persons having impaired grip strength to open containers that have tight fitting lids and the like. What is needed is a tool that enables persons having impaired hand function to accomplish common tasks that are essential to independent living, however thus far been neglected.

SUMMARY OF THE INVENTION

The instant invention is a tool that may be used by persons having diminished use of their hands to manipulate various other objects, tools and instruments in order to perform routine tasks that would otherwise be difficult or impossible owing to disability. In particular, the present invention is directed to a multi-task tool for persons having arthritis and diminished gripping strength of the hands. The present invention enables such a person to manipulate a writing tool or an eating utensil in order to write and feed themselves effectively without having the grip the utensil or writing instrument directly with the thumb and forefinger. Generally speaking, the tool is rested between the thumb and forefinger without requiring the user to oppose the thumb and forefinger in a gripping position, a property especially useful with persons having decreased flexion of the thumb or fingers. Specifically, apertures are provided in the multi-use tool for the passing through of the barrel of a writing instrument and an eating utensil such as a fork and enable the manipulation of the same without forcing the fingers of the hand to oppose the thumb. Other recesses and apertures are provided for the seating of various objects such as a tire stem cap, a vehicle gas cap and caps used with plastic juice and water bottles. Several points are provided for prying into containers, or separating the sealed mouths of food packets, such as breakfast cereal packaging. Motions employed by the user upon an object by way of the multi-use tool may be prying, turning and pulling and pushing among others.

One objective of the present invention is to provide a means for a person having diminished use of the hands to manipulate a writing instrument in order to write.

Another objective of the present invention is to provide a means for a person having diminished use of the hands to manipulate an eating utensil in order to feed themselves.

Another objective of the present invention is to provide a means for a person having diminished use of the hands to manipulate a credit card or debit card and enable self-swiping of the card at a store checkout counter.

Another objective of the present invention is to provide a means for a person having diminished use of the hands to manipulate a male-type or female-type zipper as an assist in dressing themselves.

Another objective of the present invention is to provide a means for a person having diminished use of their hands to manipulate a vehicle gas cap as an assist in fueling their vehicle.

Another objective of the present invention is to provide a means for a person having diminished use of the hands to manipulate a key in order to turn the key in a lock.

Still another objective of the present invention is to provide a means for a person having diminished use of the hands to open containers of various sorts.

Other objects and advantages of the present invention will become apparent from the following descriptions, taken in connection with the accompanying drawings, wherein by way of illustration and example, the various embodiments of the present invention are disclosed in the detailed description of the embodiments.

DETAILED DESCRIPTION OF THE INVENTION

Reference Listing for Numbered Elements

Figure 1:
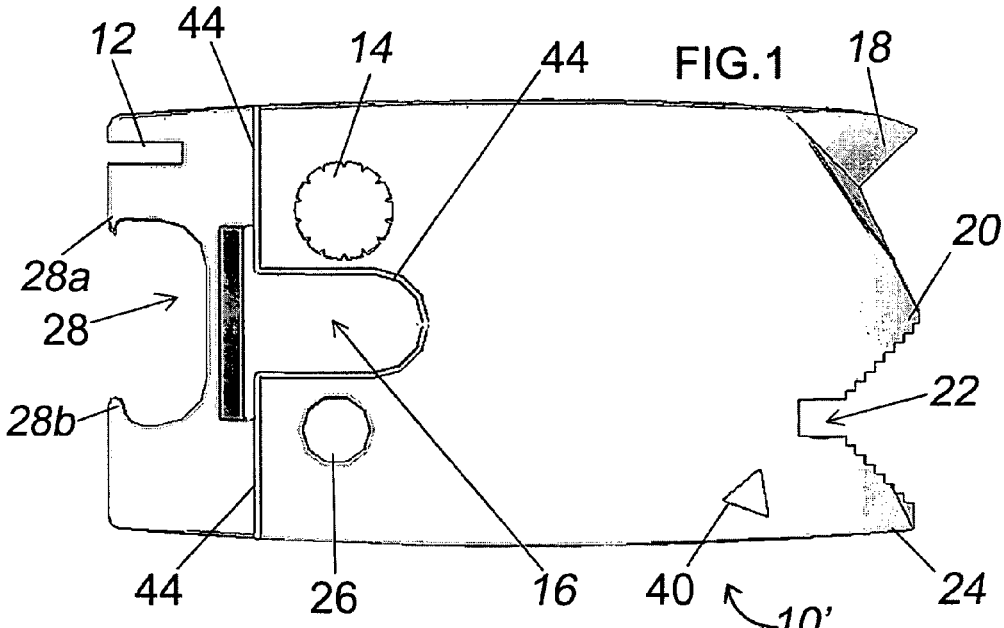
FIG. 1 is a plan view of a bottom side the preferred embodiment.
Figure 2:
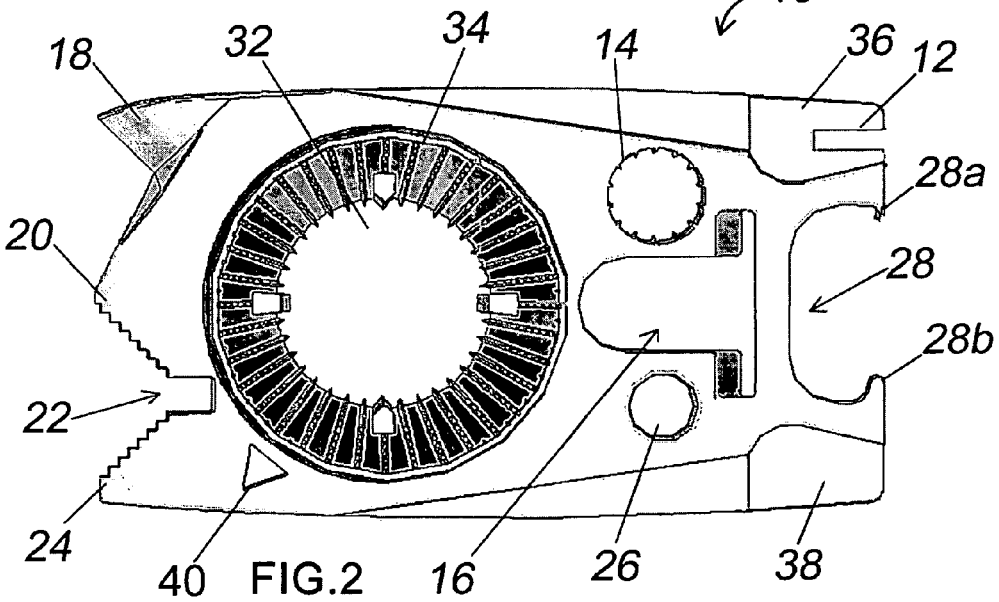
FIG. 2 is a top plan view of the embodiment of FIG. 1.
Figure 3:
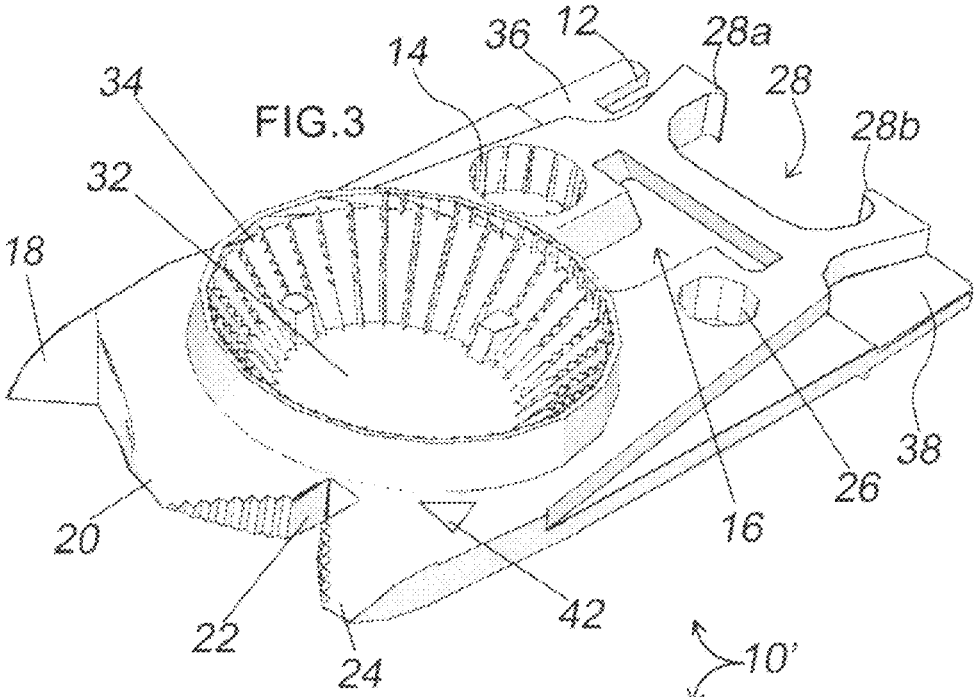
FIG. 3 is a perspective view showing the top side of the preferred embodiment according to the present invention.
Figure 4:
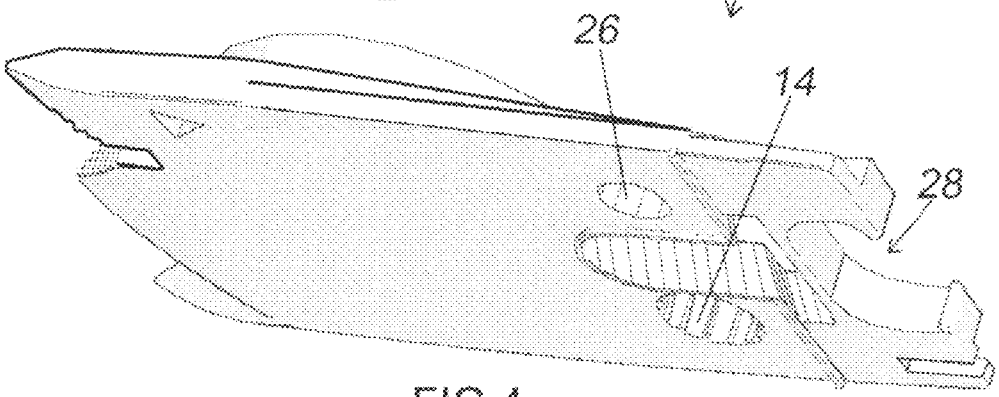
FIG. 4 is a perspective view showing the bottom side of the preferred embodiment according to the present invention.
Figure 5:
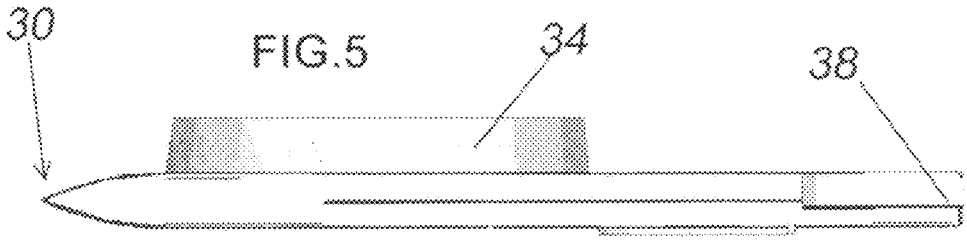
FIG. 5 is a side elevation view of the embodiment of FIG. 1.
Figure 6:
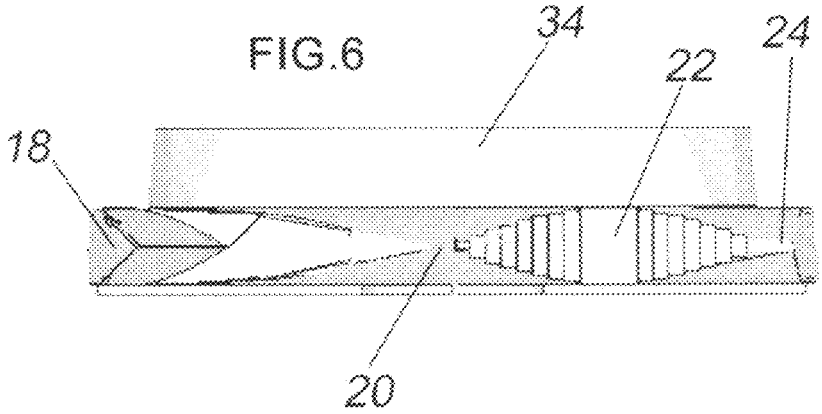
FIG. 6 is a side elevation view of the embodiment of FIG. 1 showing the key turning assist.

10' multi-use tool body
12 zipper pull
14 tire stem remover/turning assist for twist-type lamp switches
16 eating utensil assist
18 first opener for sealed packages/letters
20 second opener for sealed packages/letters
22 key turning assist
24 prying member for pop top can
26 writing instrument assist
28 gasoline fill cap assist/jar lid popper
30 tapered edge

Figure 7:
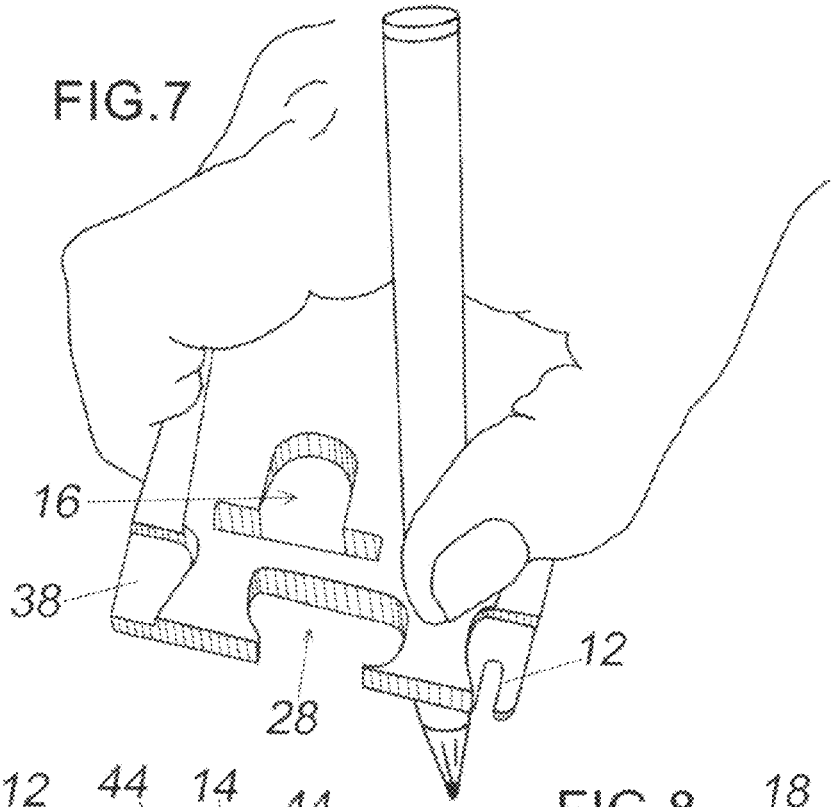
FIG. 7 is a perspective view showing an embodiment according to the present invention being used as a writing assist.
Figure 8:
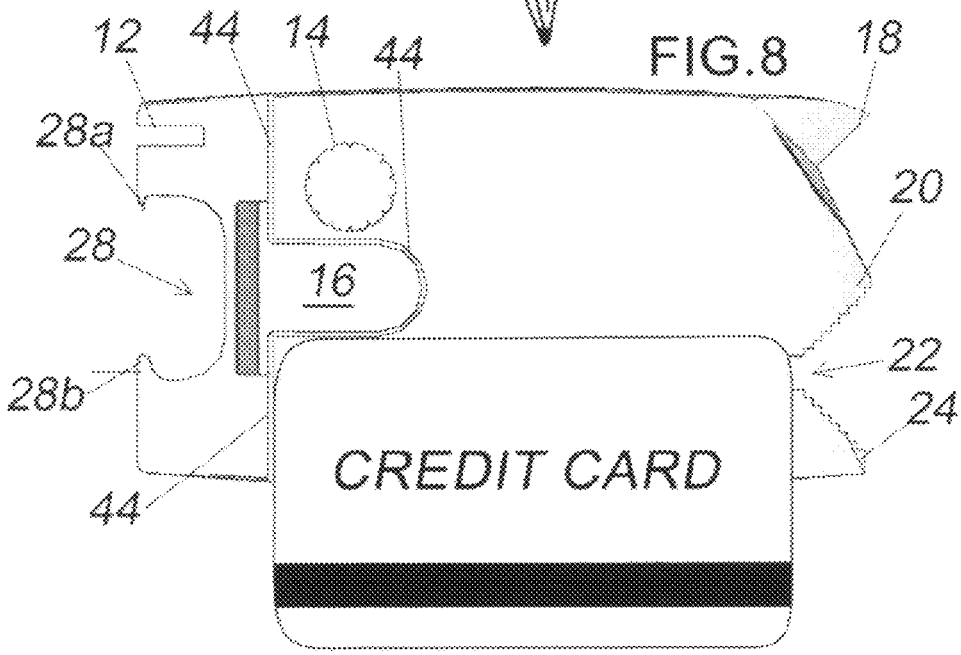
FIG. 8 is a plan view showing the embodiment of FIG. 1 according to the present invention being used as a credit card assist.
Figure 9:
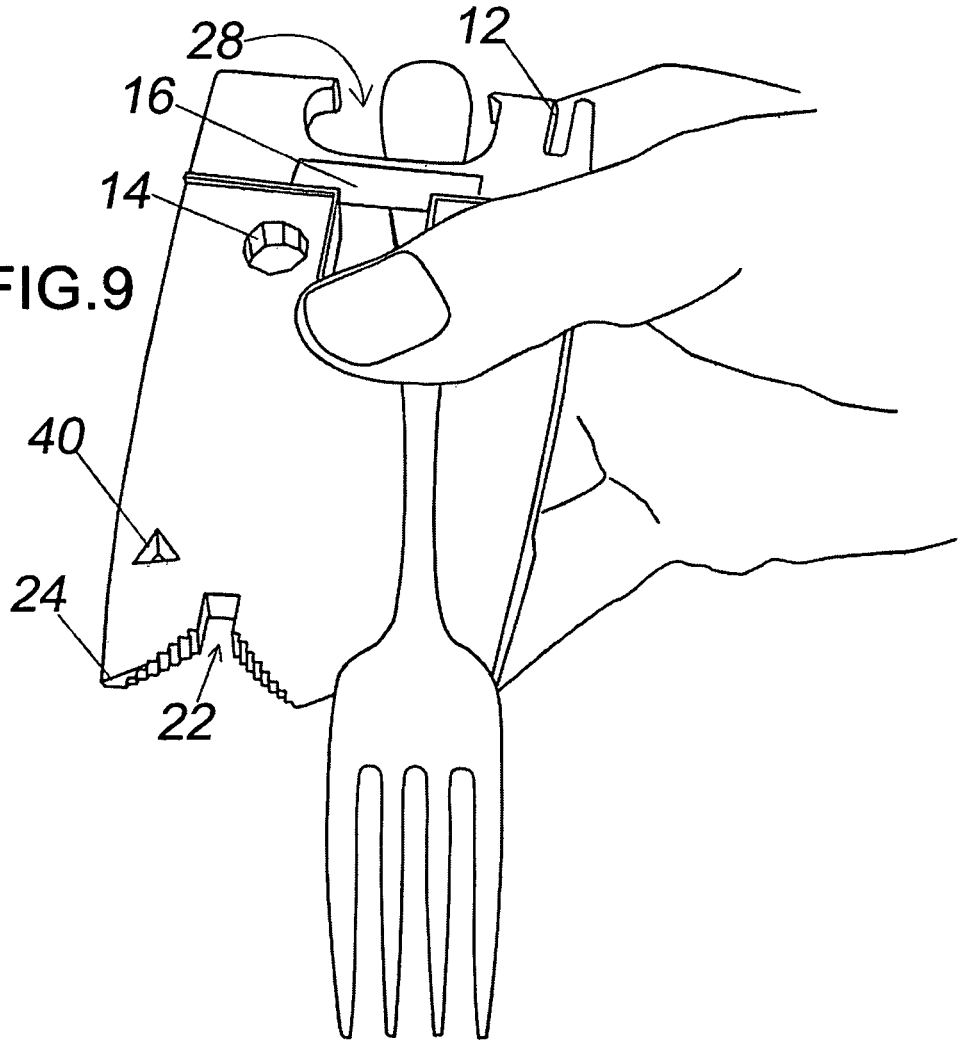
FIG. 9 is a perspective view showing an embodiment according to the present invention being used as a self feeding assist.

32 remover for metal twist-off bottle cap
34 remover for plastic twist-off bottle cap
36 male-type zipper starting guide
38 female-type zipper starting guide
40 aperture for key-chain
44 credit card assist Referring generally to FIGS. 1-9, a hand tool for persons having diminished strength or manipulative ability in their hands due to arthritis, infirmity or other physical condition, enabling such a person to work upon a variety of objects, tools and instruments commonly encountered. Generally, the ability to twist, pull, pry is provided by a number of shaped apertures, recesses and projections found through, on, or about the body of the hand tool. As shown in FIG. 7, a writing instrument assist 26 defined by a shaped aperture for the retention of the body of a writing instrument opens to both the top and bottom sides of the tool. In FIG. 9, an eating utensil assist 16 defined by a shaped aperture for the retention of the handle of an eating utensil also opens to both the top and bottom sides of the tool, and has a beveled interior wall of preferably between degrees and degrees for retention of the utensil handle at a natural angle; preferably 30 degrees relative to the bottom side of the tool. A tire stem cap remover 14 defined by yet another shaped aperture for receiving and turning tire stem cap is located between the top and bottom sides of the tool.

Several shaped recesses designed to first securely seat an object thereby allowing the object to be turned or pried are located on the body of the tool; a generally frustro-conical recess 34 (FIG. 2-3) with ribbed walls formed on the top of the tool may mate-ably seat, and enable the turning of a variety of plastic container caps of different sizes, while a group of projections at the terminal end 32 of the frustro-conical recess may mate-ably seat and enable the turning of a metal cap of the type found on juice bottles. A number of recesses are formed about the perimeter of the tool. A zipper pull 12 defined by a recesses for seating the tang of a zipper in order to pull the zipper open or closed, and a pair of zipper guides 36, 38 defined by recesses shaped to accommodate a mens' and womens' style zippers respectively, are found on the perimeter of the tool. A key turning assist 22 defined by a recess for the seating of the head of a key is formed into the perimeter on one side of the tool and enables a person to turn a key by fitting the head of a key therein. A gasoline fill cap assist 28 formed in the tool opposite the key turning assist, and defined by a recess shaped for the receiving of the handle of a vehicle gas cap is formed on the side and allows an individual to twist a gas cap open or closed by levering the sides of the recess against the gas cap handle.

Several shaped projections are found adjacent to the shaped recesses of the tool body; opener 18 may be used to slit open a letter, and openers 22 and 24, may be used to open food packages of various types, especially those plastic packages where the closure is secured with adhesive, such as a cereal box. Two other projections 28*a* and 28*b* are shaped to pry open a pop-off type of jar lid by placing on projection under the lip of the lid and prying. Shaped projection 24 is also used effectively as a prying member for opening pop-top cans. As most clearly observed in FIGS. 5-6, the tool is tapered 30 from the bottom and top sides to produce an edge where the openers are formed in the perimeter.

A credit card assist 44 defined by a transverse ridge molded adjacent to the eating utensil assist 16 is shaped for the abutted placement of an edge of a credit or debit card to facilitate the swiping of the card at a store checkout counter.

The multi-task tool may be made from injection molded plastic or cast or sintered metal. Although the preferred embodiment is made of one material, as would be understood by one skilled in the art, conceivably the tool may be made from a combination of materials while retaining the overall shape, use and configuration of the disclosed invention.

The aforementioned description is not intended to limit the scope of the invention to the particular embodiment set forth, but on the contrary, it is intended to cover such alternatives, modifications, and equivalents as may be included within the spirit and scope of the description in view of the appended drawings and claims.

What is claimed is:

1. A hand-held tool with a top side, a bottom side, and a perimeter to be used by persons having diminished grip and fine motor skills for purposes of manipulating objects, comprising:

a plurality of apertures, wherein at least four of the apertures are placed within and share a common plane on the top and bottom sides, at least one of the apertures is shaped for the reception and passage therethrough of an eating utensil and the releasable retention of the eating utensil thereof, at least one of the apertures is shaped for the passing through and releasable retention of a barrel of a writing instrument, and wherein the apertures shaped for the handle of the eating utensil and for the barrel of a writing instrument enable the person to perform the functions of eating and writing having to oppose the thumb and fingers together in a gripping position: and, a plurality of shaped recessed, each recess shaped to receive an object for the purpose of manipulating the object.

2. The hand-held tool of claim 1 in which the eating utensil is maintained at a 20 to 30 degree angle relative to the bottom side of the tool.

3. The hand-held tool of claim 1 further comprising a plurality of projections about the perimeter shaped for prying into, and opening containers.

4. The hand-held tool of claim 1 in which the plurality of recesses further comprise recessed guides for guiding a pin portion of a zipper into a slide portion of a zipper when the slide portion is on the left or right side of a garment opening.

5. The hand-held tool of claim 1 further comprising at least one recess shaped for the reception of a portion of a vehicle gas cap.

6. The hand-held tool of claim 1 further comprising at least one recess shaped for the reception of a portion of a jar lid.

7. The hand-held tool of claim 1 further comprising at least one recess shaped for the reception of a portion of a tire stem cap.

8. The hand-held tool of claim 1 further comprising at least one side adapted for use for the retention of a credit card.

9. The hand-held tool of claim 1 further comprising at least one ridge shaped for the reception of a portion of a credit card.

10. The hand-held tool of claim 1 further comprising at least one recess shaped for the reception of a portion of a container cap.

* * * * *